US010883235B2

(12) United States Patent
Norstad et al.

(10) Patent No.: US 10,883,235 B2
(45) Date of Patent: Jan. 5, 2021

(54) WINCH AND PLOW CONTROL SYSTEM

(71) Applicant: Polaris Industries Inc., Medina, MN (US)

(72) Inventors: Timothy P. Norstad, Turtle Lake, WI (US); Joseph P. Nuxoll, San Jose, CA (US); Elaine M. Scott, San Francisco, CA (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 16/436,644

(22) Filed: Jun. 10, 2019

(65) Prior Publication Data

US 2019/0382248 A1 Dec. 19, 2019

Related U.S. Application Data

(60) Provisional application No. 62/684,441, filed on Jun. 13, 2018.

(51) Int. Cl.
*E01H 5/06* (2006.01)

(52) U.S. Cl.
CPC ..... *E01H 5/06* (2013.01); *E01H 5/063* (2013.01); *E01H 5/065* (2013.01)

(58) Field of Classification Search
CPC ..... B60L 7/10; B60L 11/02; B60L 2210/10; E01H 5/06; E01H 5/063; E01H 5/65
See application file for complete search history.

(56) References Cited

U.S. PATENT DOCUMENTS

| | | | | |
|---|---|---|---|---|
| 6,131,062 | A * | 10/2000 | Nielsen | H04L 29/06 172/2 |
| 8,424,632 | B2 * | 4/2013 | Ruhter | E02F 9/16 180/320 |
| 8,914,215 | B2 * | 12/2014 | Faivre | B60W 50/0098 701/84 |
| 9,086,698 | B2 * | 7/2015 | Faivre | E02F 9/2075 |
| 9,388,551 | B2 * | 7/2016 | Faivre | E02F 9/2079 |
| 9,551,366 | B2 * | 1/2017 | O'Donnell | E02F 3/961 |
| 2008/0201994 | A1 * | 8/2008 | Crago | E01H 5/06 37/197 |
| 2016/0146335 | A1 * | 5/2016 | McGuire | F16H 63/18 701/51 |

* cited by examiner

*Primary Examiner* — Rina I Duda
(74) *Attorney, Agent, or Firm* — Harness Dickey

(57) ABSTRACT

A winch and plow control system is disclosed. The winch and plow control system enables automatic control of a plow attached to a vehicle in order to raise and lower the plow based upon a vehicle parameter. The vehicle parameter can be a gear input that is monitored to automatically raise and lower the plow depending upon the gear selected. Wireless and remote control of the winch is also available, as well as a back-dragging automatic plow mode and a normal automatic plow mode.

18 Claims, 17 Drawing Sheets

WINCH AND PLOW CONTROL SYSTEM

CROSS-REFERENCE TO RELATED APPLICATIONS

This application claims the benefit of U.S. Provisional Application No. 62/684,441, filed on Jun. 13, 2018. The entire disclosure of the above application is incorporated herein by reference.

FIELD

The present disclosure relates to a winch control system, and more particularly, to a winch and plow control system for a vehicle.

BACKGROUND

This section provides background information related to the present disclosure which is not necessarily prior art.

The use of a winch on vehicles is well known in the art. Winches can be used to extricate or move a vehicle should the vehicle become stuck, particularly in off-road applications. Winches can also be used to move debris or items blocking a path of the vehicle. Winches can also be used to work in concert with other vehicle systems such as a plow system to raise and lower plows.

During snow plowing, the user or rider of the vehicle generally must raise and lower the plow, via the winch, many times when using the plow. In this regard, generally when the vehicle is moved forward and/or in reverse, the plow is lowered to move snow to the desired area. Once moved, the plow is raised and the vehicle is moved in another direction as desired. This requires the user to both control the vehicles forward and reverse gears, as well as the positioning of the plow in the up and down positions. This control generally takes additional time and effort during the plowing operation since the plow and the vehicle direction is changed many times throughout the plowing process. Therefore, it would be desirable to provide a more efficient winch and plowing control system for operating a winch on a vehicle.

SUMMARY

This section provides a general summary of the disclosure, and is not a comprehensive disclosure of its full scope or all of its features.

A winch and plow control system for use in controlling a plow relative to a vehicle is provided. The system includes a display module having an input for receipt of a vehicle parameter, such as a gear selection. The display module also includes buttons for mode selection and manual control of the plow. The plow can be operated in a manual mode or a plow mode. In the plow mode, the plow is automatically lowered when the vehicle parameter detected is low or forward gear selected. The plow is raised when the vehicle parameter detected is reverse gear selected. In a backdrag plow mode, the plow is raised if the vehicle parameter detected is low or forward gear. If the gear detected is reverse, the plow is lowered automatically in the backdrag mode. The winch may also be controlled remotely or wirelessly, via a remote or wireless device, to control the winch with the occupant not being present within the vehicle.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
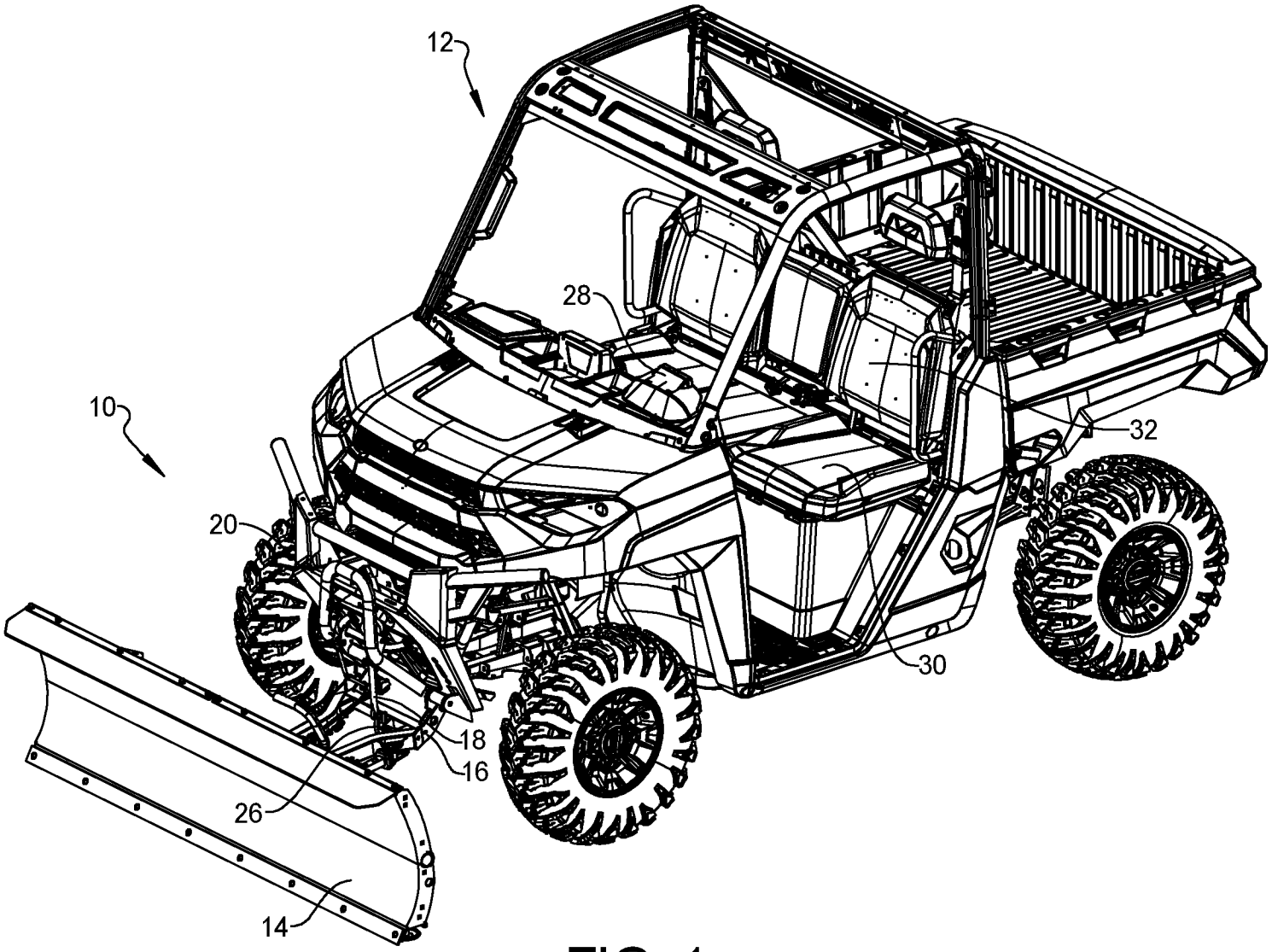
FIG. 1 is a perspective view of an off-road vehicle or utility vehicle having a winch and plow assembly of the present disclosure.

FIG. 1 illustrates a winch and plow control system 10 shown associated with an off-road or utility vehicle 12. While the off-road vehicle 12 illustrated can be a Polaris Ranger® utility vehicle, sometimes also referred to as a side-by-side vehicle, any type of vehicle can utilize the winch and plow control system 10. For example, a plow associated with a Polaris Sportsman® ATV or other utility vehicle can also be controlled using the winch and plow control system 10 of the present disclosure. As illustrated in FIG. 1, a plow 14 is attached to the vehicle 12 by way of support arms 16 and is raised and lowered by way of the cable 18 attached to the winch 20 located within the front of the vehicle 12. The plow 14 can be the Glacier® Pro Plow and the support arms 16 can be the Glacier® ProPlow Frame, each offered by Polaris Industries of Medina, Minn. Any other plow or frame can also work with the winch and plow control system 10. The winch 20 can be a Polaris® HD winch with auto-stop, also offered by Polaris Industries Inc. of Medina, Minn., or any other appropriate winch 20.

Figure 3:
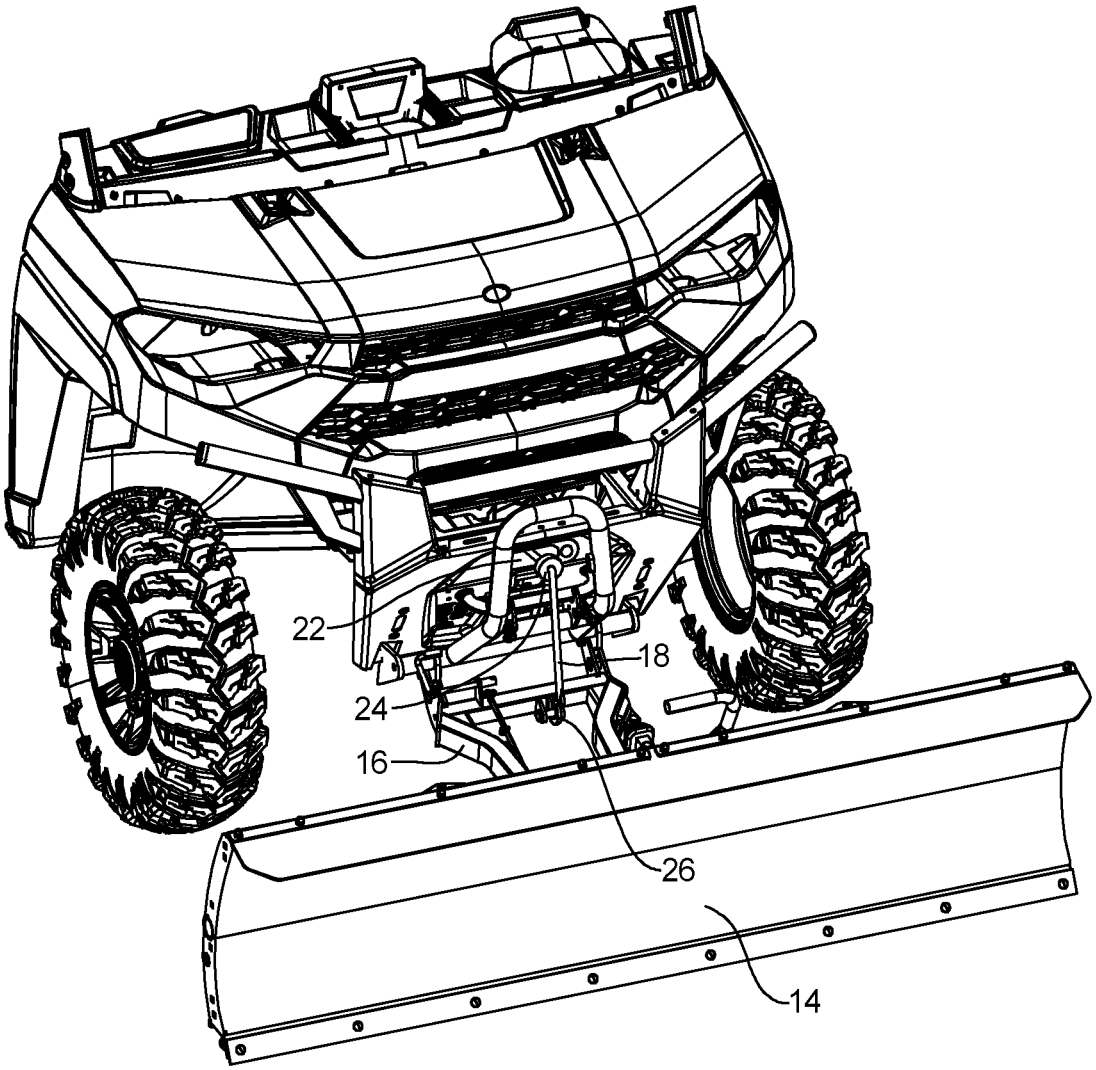
FIG. 3 is a perspective view of the plow assembly attached to the vehicle in the down or lowered position.
Figure 5:
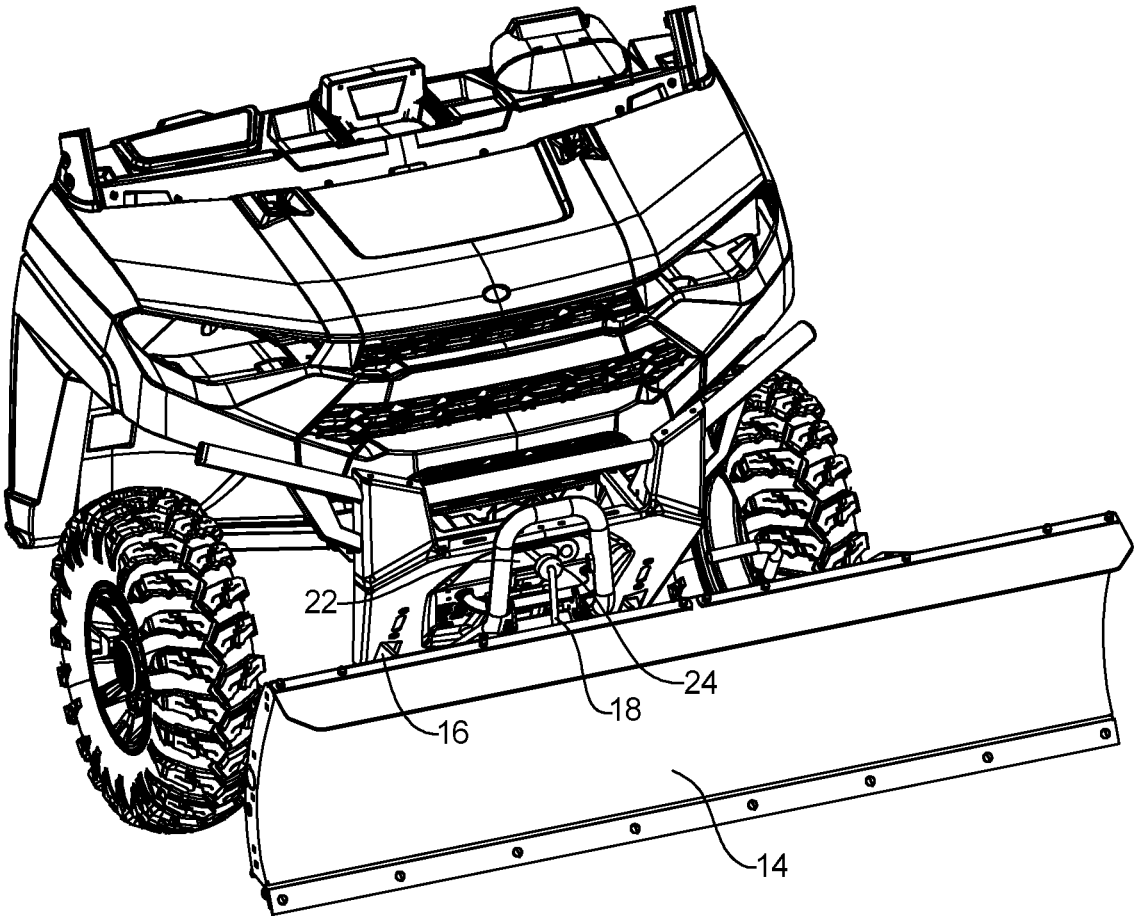
FIG. 5 is a perspective view of the plow assembly attached to the vehicle in the up or raised position.
Figure 6:
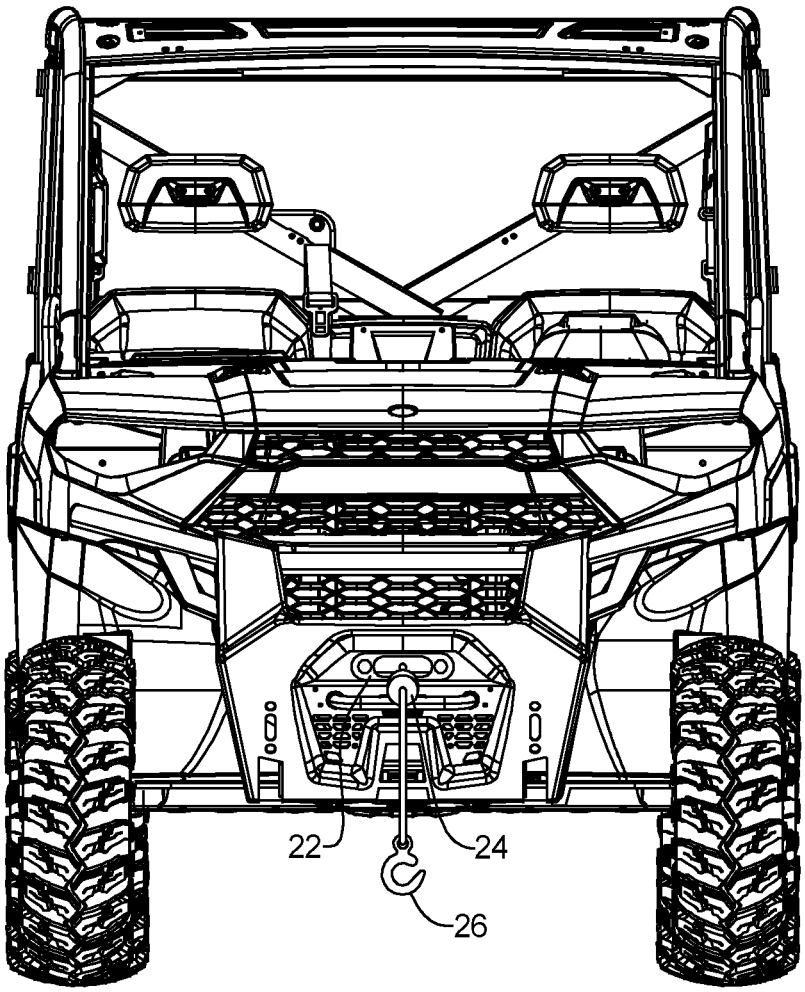
FIG. 6 is a front view of the vehicle illustrating an auto-stop assembly associated with the winch and plow assembly.

As illustrated more clearly in FIGS. 3, 5, and 6, a fairlead 22 is illustrated in the front of the vehicle 12 that works with an auto-stop grommet or rubber bumper 24, further discussed herein. At the distal end of the cable 18 is a hook 26 that couples to the support arms 16 to enable the support arms 16 to raise and lower the plow 14, via the winch 20 and cable 18. In order to control the raising and lowering of the plow, a display 28 associated with the vehicle, further illustrated in detail in FIGS. 11-13B, provides an interface for a user of the vehicle 12 to control the winch 20, as well as raise and lower the plow 14. Also associated with the operation of the plow 14 can be an optional operator presence switch 30 that can be embedded in the driver seat 32 to optionally allow for raising and lowering the plow 14 only during the presence of a driver or user in the vehicle 12 positioned within the driver seat 32. The optional operator presence switch 30 can also be associated with the shift lever or other control to detect the presence of a user for use in controlling the plow 14.

Figure 2:
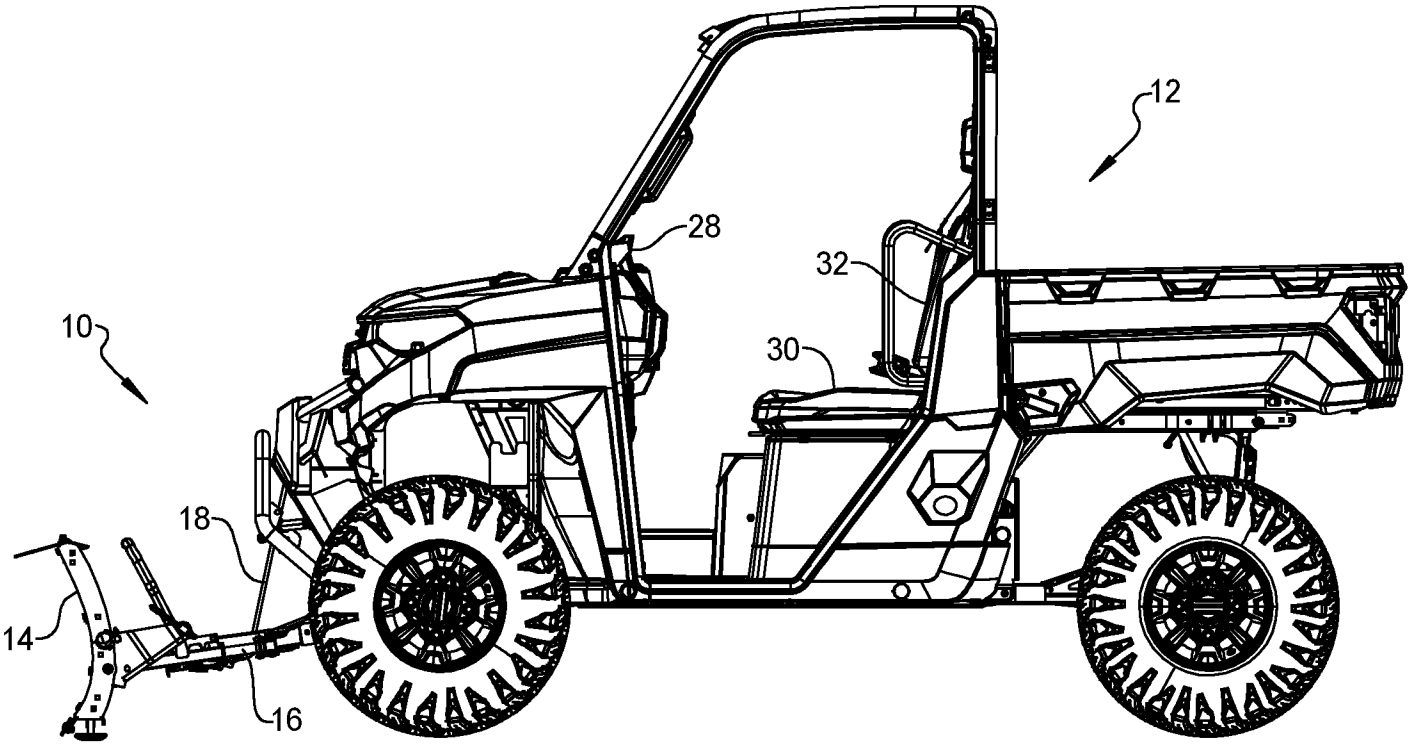
FIG. 2 is a side view of the vehicle of FIG. 1 with the plow shown in the down or lowered position.
Figure 4:
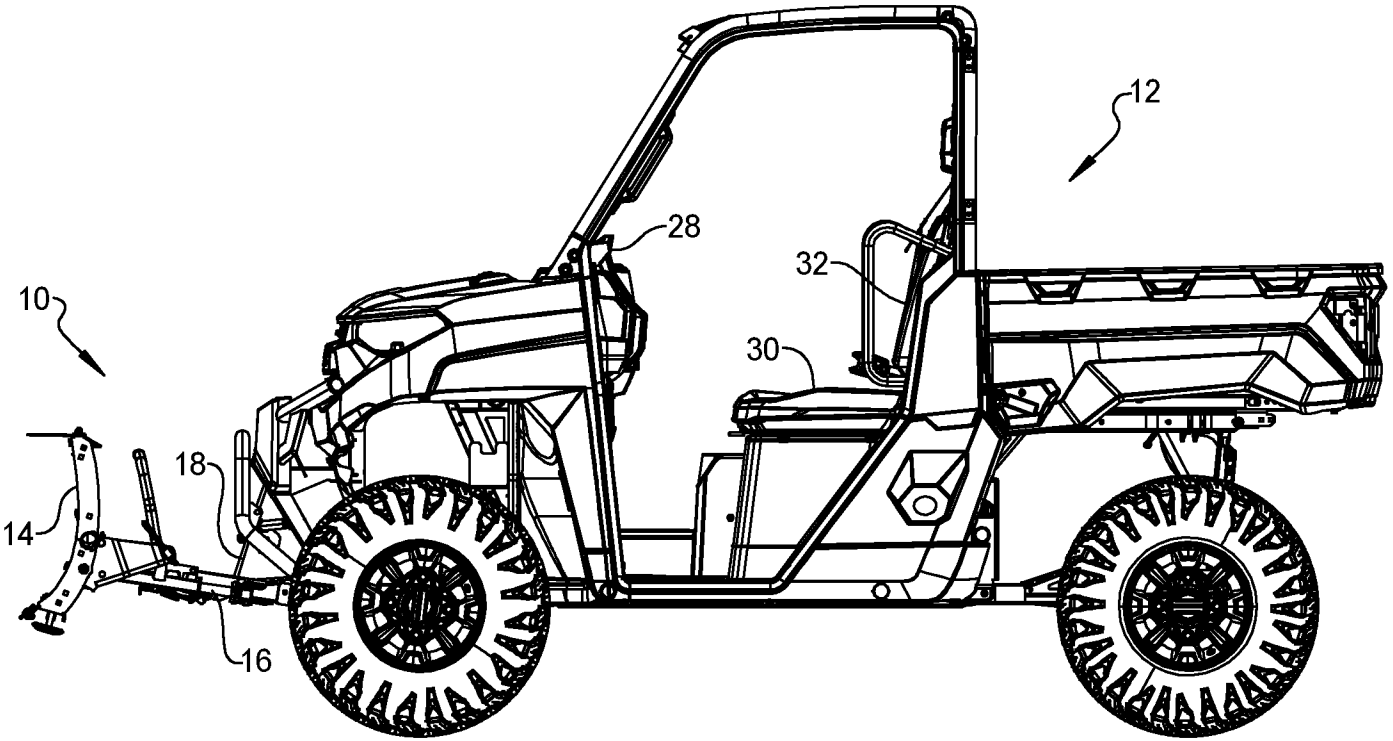
FIG. 4 is a side view of the vehicle of FIG. 1 with the plow shown in the up or raised position.

As illustrated in FIGS. 2 and 3, the plow 14 is shown in the down or lowered position. In this position, the plow 14 can be used to either push snow or debris when the vehicle 12 is moving forward. Alternatively, the plow 14 can be used to pull debris away from an area, such as a garage door, when the vehicle 12 is moving in reverse or backwards. FIGS. 4 and 5 illustrate the plow 14 in a raised or up position relative to the vehicle 12. In this condition, the vehicle 12 can be moved either forward or in low gear or backwards or reverse gear to move to a desired location without the plow 14 engaging snow or debris. Further discussions of the manual and automatic raising and lowering of the plow 14 will be discussed further herein.

Figure 7A:
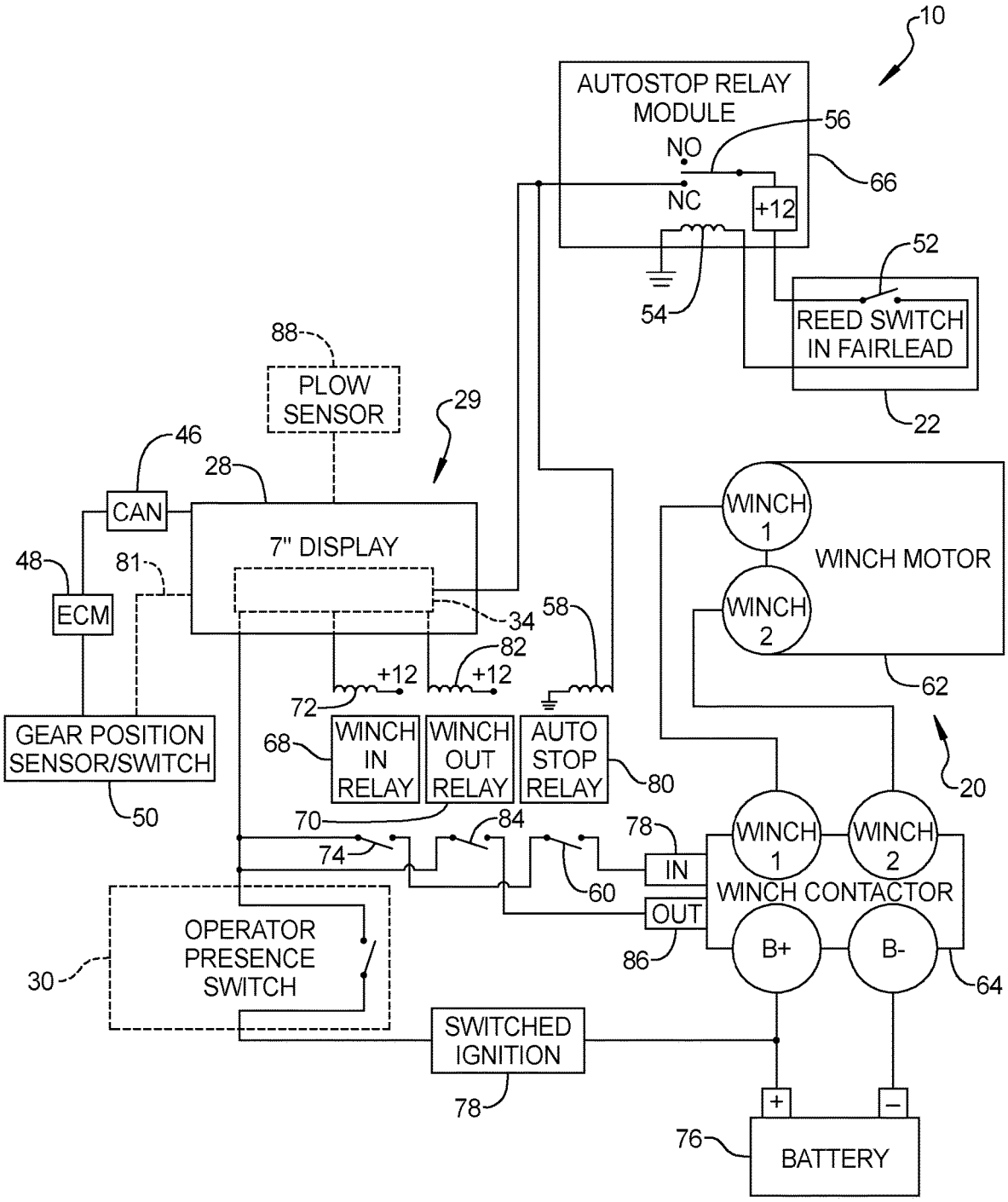
FIG. 7A is a schematic block diagram of a winch and plow control system of the present disclosure.

Referring to FIG. 7A, a schematic block diagram of the winch and plow control system 10 that is used with the optional hard-wired operator presence switch 30 is illustrated in detail. In this regard, should it be desired, the optional switch 30 can simply be eliminated and the switch 30 could be replaced with a hard wire or acting as an always closed switch. The winch and plow control system 10 includes the display 28 having a processor or a controller 34 associated with the display 28. The display 28 and combined processor 34 can also be referred to as a display module 29. The display module 29 or processor 34 will include memory to run and operate the system 10 as is known in the art.

Figure 11:
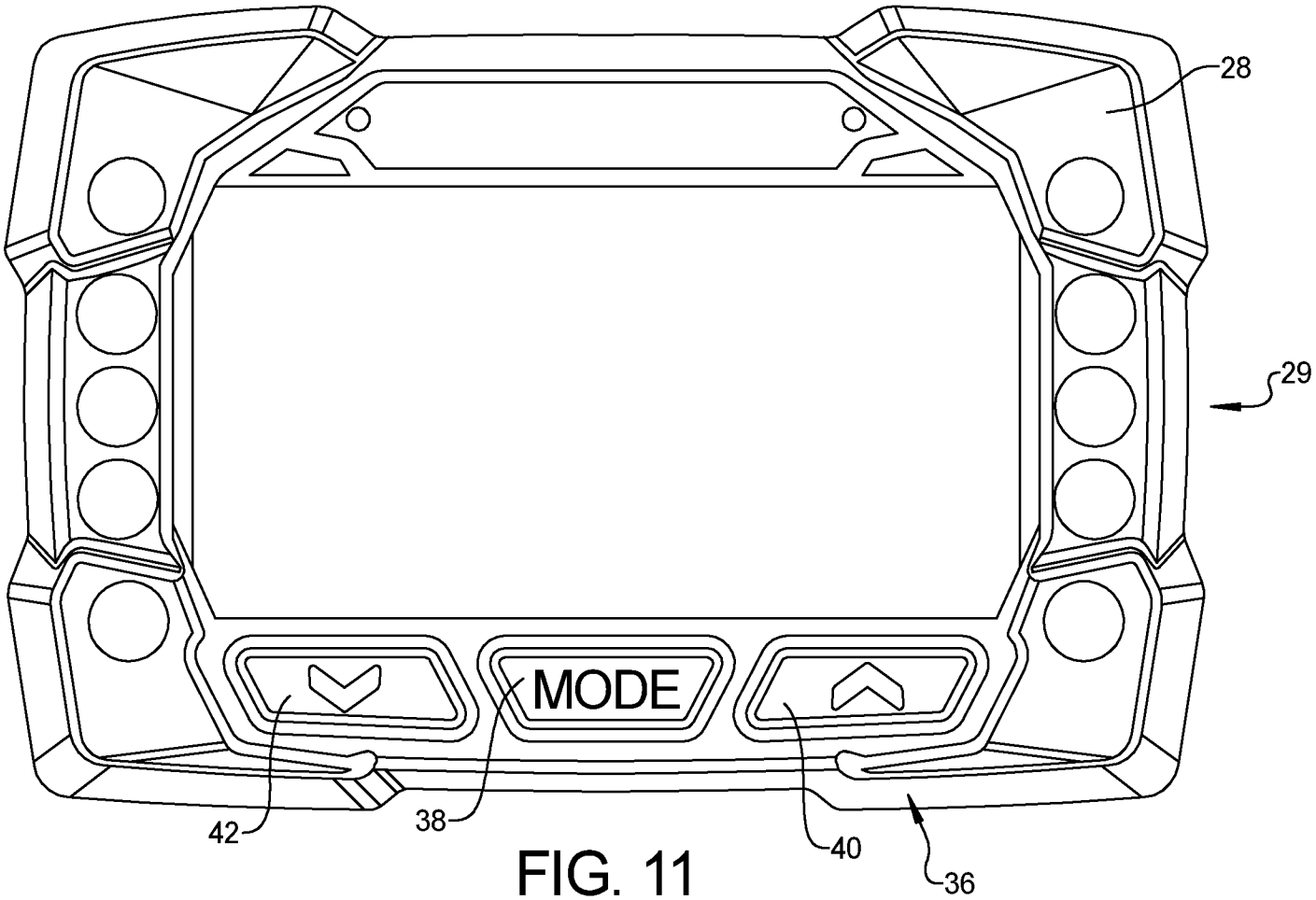
FIG. 11 is an illustration of the display used in the present disclosure, as well as the plow and mode controls in the display.

The display module 29, further illustrated in detail in FIG. 11, includes a three-button interface 36 that is used to control the winch 20 and plow 14. As illustrated in FIG. 11, the three-button switch 36 includes a mode switch or button 38 that can be toggled to switch between various modes for controlling the winch 20 and plow 14. Modes may include an automatic plow mode normal operation and automatic plow mode backdrag operation or mode (further discussed herein) or a manual mode. In the manual mode, an up arrow button 40 can be actuated to raise the plow 14 and a down arrow button 42 can be actuated to lower the plow 14.

By providing the display module 29 with the plow controls, via the three-way button interface 36 which can be a touch screen interface and/or discreet buttons, there is no need to provide a separate switch assembly for controlling the plow and the plow can be controlled, via the existing display module 29 on the vehicle 12. The display module 29 also provides other information to a user as is known, such as vehicle speed, RPM, fuel level, and engine parameters, such as engine temperature, pressure, etc.

Figure 12A:
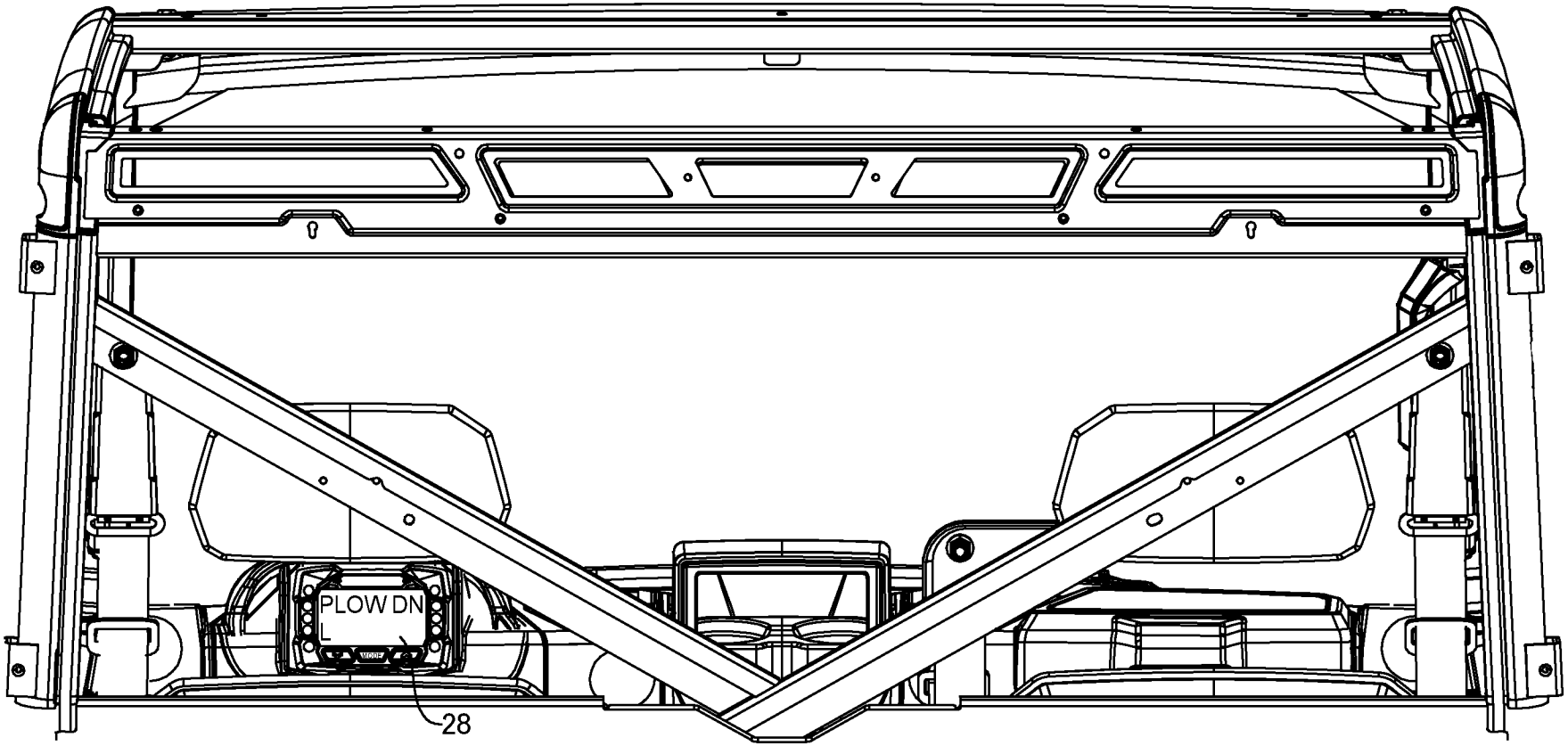
FIGS. 12A and 12B are views of the display illustrating information regarding plow up and plow down conditions during the plow mode.
Figure 12B:
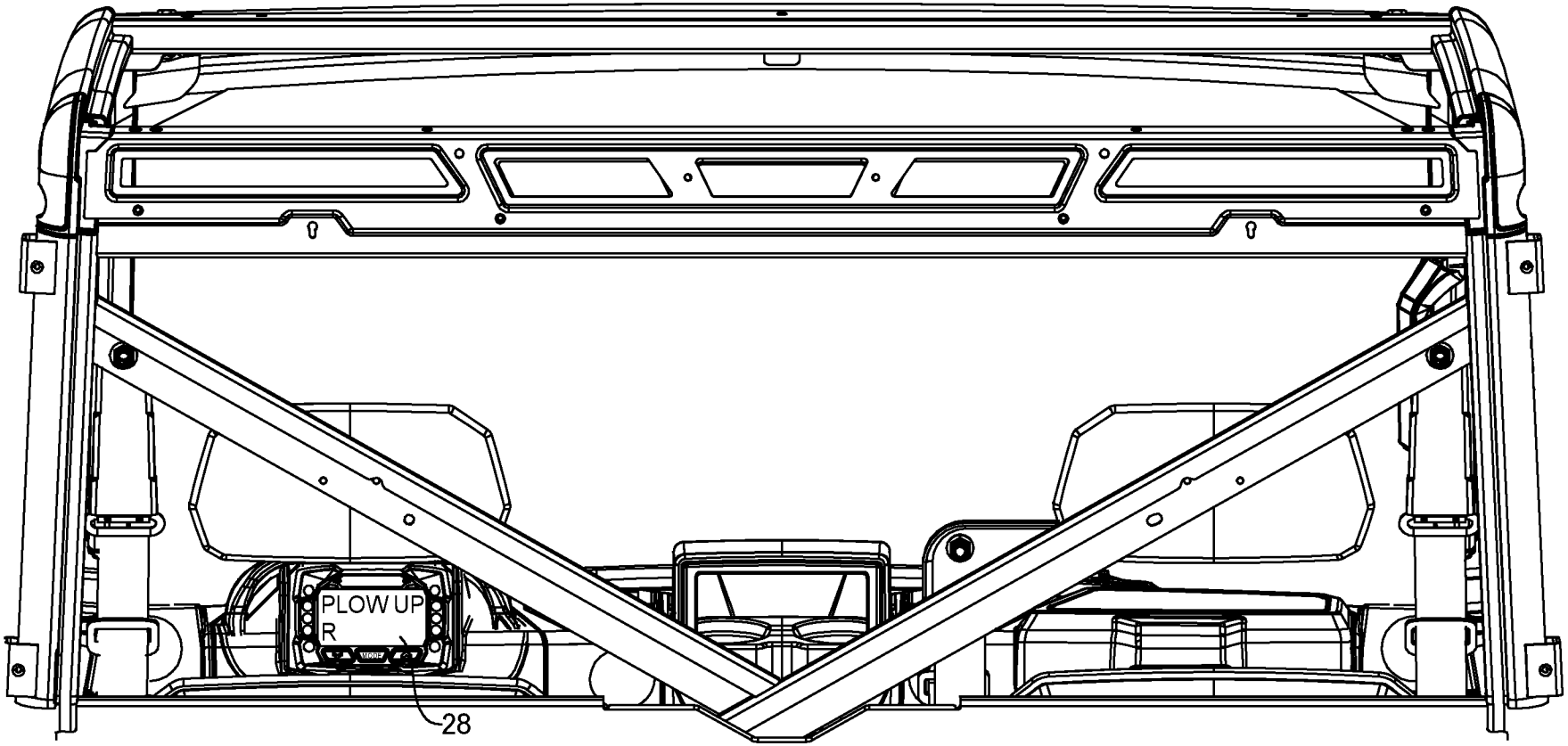

Accordingly, in a winch control mode, or "winch mode", the winch can be manually controlled via the up switch 40 and the down switch 42 to spool the cable 18 either in or out, depending on the user's desire. The winch 20 may also be controlled remotely, as further discussed herein. In the plow mode, the user can either manually adjust the plow upward or downward with the up switch 40 and down switch 42. Alternatively, in the auto plow mode, the plow can be controlled via the processor 34 and the display 28, as further discussed herein. As illustrated in FIG. 12A, the display module 29 is operated in the auto plow mode identifying that the plow is down when the vehicle 12 is in forward or low gear. In FIG. 12B, it is illustrated on the display module 29 that the plow is up when the vehicle 12 is in reverse.

Figure 13A:
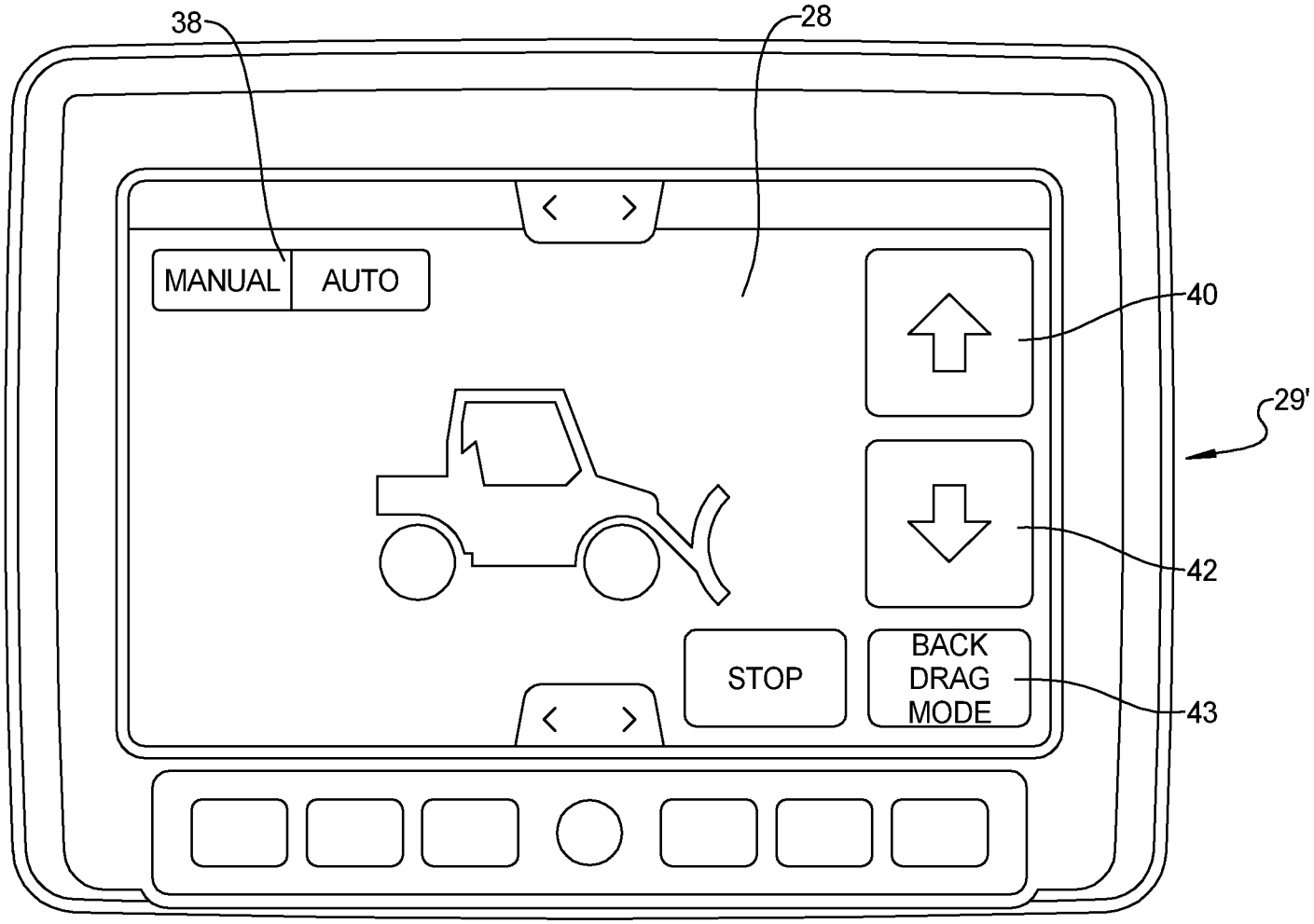
FIGS. 13A and 13B are an illustration of an alternate display used in the present disclosure illustrating use of the plow up and plow down controls.
Figure 13B:
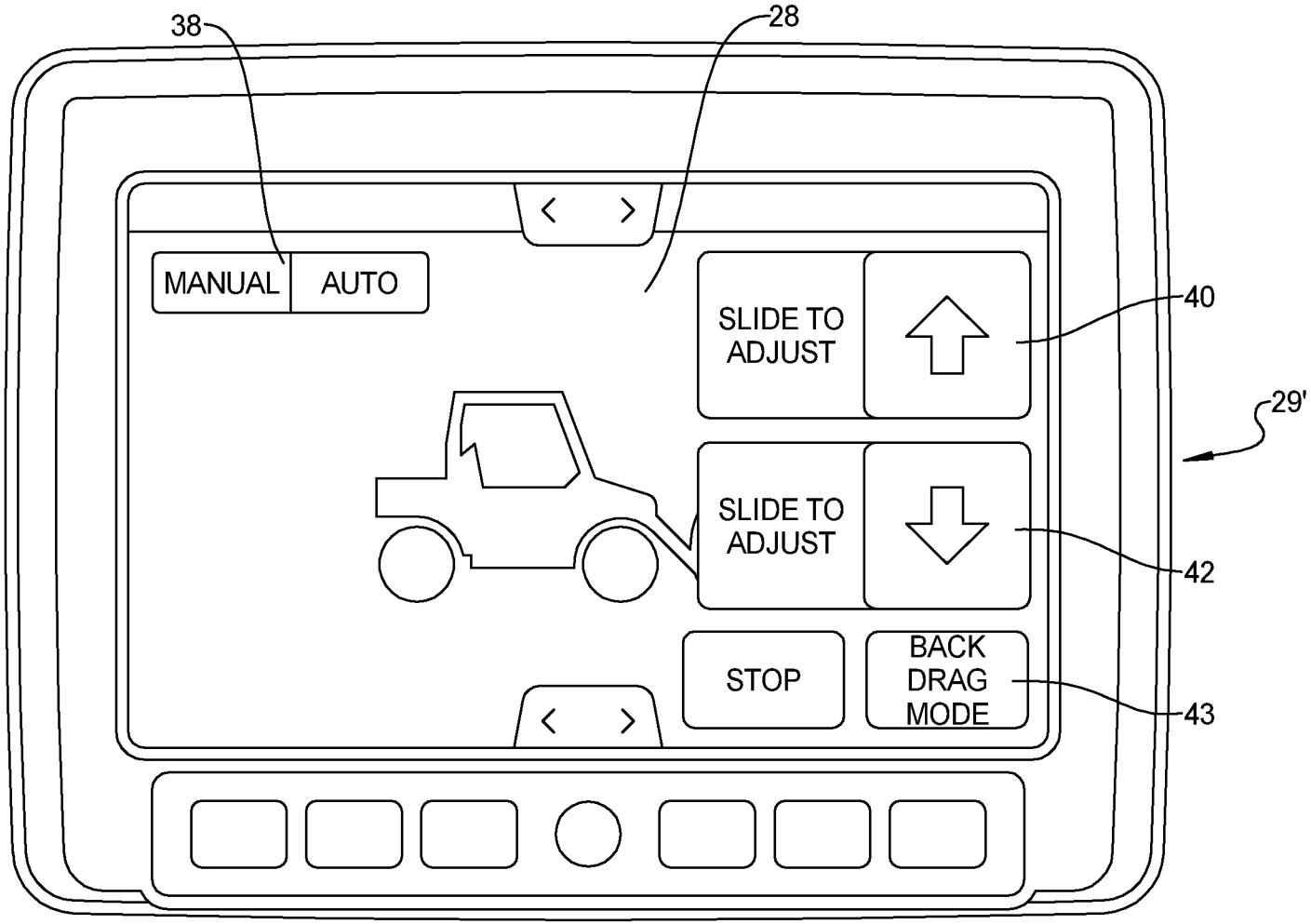

As illustrated in FIGS. 13A and 13B, an alternative display module 29' is illustrated. The display module 29' can be used in place of the display module 29 discussed herein and operates the same as the display module 29, except that the discrete mode switch 38 and the up and down switches 40 and 42 are now part of the capacitive touch screen. In this regard, the display module 29', illustrated in FIGS. 13A and 13B, is similar to the display module 29 of FIG. 11 and like reference numerals will be used to identify like structures.

Here again, the mode switch 38 is part of the touch screen to select between the manual mode or the auto plow mode. A switch 43 is used to select a back drag mode. The up direction button 40 is used to manually raise the plow and the down direction button 42 is used to lower the plow 14. As illustrated in FIG. 13A, the up arrow button 40 and the down arrow button 42 are illustrated on the touch screen 28 before a user touches the touch screen interface. As illustrated in FIG. 13B, once a user contacts either the up arrow button 40 or the down arrow button 42, the display screen 28 displays a further instruction "slide to adjust" that appears to the left of each arrow. In order to raise or lower the plow 14 using the touch screen buttons 40 and 42, this requires the user to slide or swipe with the user's finger to the left on the display 28. This enables actuation for raising and lowering the plow 14 by a touch and swipe or slide finger action. Such a control is provided to prevent false actuation of the plow 14, such as by inadvertently simply contacting the up or down buttons 40 and 42 on the capacitive touch screen 28 or by other debris, rain, mud, or other unwanted touching events that may inadvertently actuate the plow 14. Such a touch and swipe feature provides a further level of confidence and control in moving the plow 14 in the desired direction. It should further be pointed out that, while the touch and swipe is to the left direction, the touch and swipe can be in any direction relative to the initial contact and simply requires a first and a subsequent second screen action to confirm the desired movement. The display module 29' also provides all of the other vehicle information, as noted above, with regard to the display module 29. It should also be pointed out, upon reference throughout the specification, to the display module 29 or 29' are interchangeable and either display can be used with the present systems 10, 10', and 10".

When the display module 29 is set to the "plow mode", the system 10 allows for automatic plow up and plow down operation based on messages or vehicle parameters received via the vehicle's communication bus, known as a CAN bus (controller area network) 46. During snow plowing, the user or rider must raise and lower the plow 14 (via the winch and/or hydraulics) many times. In general, the plow 14 is down or lowered when driving forward or in low gear, and is raised or in the up position when backing up or in reverse gear. By monitoring the CAN bus 46, the display 28 and processor 34 can automate the process of raising and lowering the plow 14 based on a CAN message indicating vehicle gear position a parameter sensor, such as from an engine control module 48, via a gear position sensor switch 50. Alternatively, an analog input 81 to the processor 34 can be directly provided by the gear position sensor switch 50, as opposed to through the bus communication line 46, if desired. During the process of snow plowing, it is also sometimes desirable to leave the plow down when backing up (back-dragging). This allows snow to be pulled back from an area before the plow is lifted to its raised or up position. Such a control is also available via the display module 29, further discussed herein.

As illustrated in FIG. 7, the system 10 works with the existing Polaris® HD winch having the auto-stop feature that turns off the winch 20 or plow mechanism as the cable 18 is retracted into the winch 20. The auto-stop feature includes the fairlead 22 that uses a reed switch 52 positioned in the front of the vehicle 12. The rubber grommet or stopper 24 includes a plurality of magnets that, when positioned in proximity to the reed switch 52, causes the reed switch 52 to close thereby delivering 12 volts to solenoid 54 to toggle the switch 56. This delivers 12 volts to solenoid 58 to open switch 60, thereby turning off winch motor 62 by no longer delivering power to the winch motor 62 through winch contactor 64, further discussed herein. The signal from the auto-stop relay module 66 is also provided to the controller 34 of the display 28. Thus, the auto stop feature enables the winch 20 to be automatically turned off by way of the proximity of the magnets in the rubber stopper or grommet 24 being positioned relative to the reed switch 52 associated with the fairlead 22.

In order to automatically control the winch motor 62, via the display 28, the display 28 or processor 34 provides a pair of low side drivers that are in association with a winch-in relay 68 and winch-out relay 70. For example, when the vehicle 12 is put into reverse, gear position sensor 50 senses this location and provides this information either directly through the analog input 81 or through the CAN bus 46 to the display module 29, via the ECM 48. The display 28 having the processor 34 provides ground to solenoid 72 thereby closing switch 74 of relay 68 to deliver 12 volts from the operator presence switch 30 to the winch contactor 64. This 12 volts is delivered via a battery 76 through ignition switch 78.

With the switch 74 closed and the switch 60 closed, 12 volts is delivered to the winch-in input 78 of winch contactor 64 to deliver and provide positive (+) polarity of 12 volts on winch contact 1 and a negative (−) polarity on winch contact 2 to winch motor 62. As is known, the winch contactor 64 is an H-bridge that switches polarities to the winch motor 62 to drive the winch motor 62 in one of two directions. During the winch-in direction, the winch 20 is turned to draw the cable 18 into the winch 20 until the auto-stop module 66 detects the rubber stopper or grommet 24 to open the switch 60 of the auto-stop relay 80 to stop the plow 14 after it is raised to the desired position. This stops 12 volts being delivered to the winch motor 62 to stop movement of the plow 14 automatically.

When the gear position sensor switch 50 senses a forward or low gear, this signal is also sent to the display module 29, via the CAN bus 46 or directly via the analog input 81 in order to provide ground to solenoid 82 to close switch 84 of the winch-out relay 70. This provides 12 volts to the winch-out input 86 of winch contactor 64 thereby providing a positive (+) polarity to the winch 2 output and a negative (−) polarity to the winch 1 output to lower the plow 14 by running the motor 62 in the winch-out direction. In lowering the plow 14, the processor 34 can either be set to a specific time for lowering the plow 14. Once this time has elapsed, the winch out relay 70 can be actuated by the display module 29 or processor 34 to open switch 84, thereby turning off the winch motor 62.

Alternatively, the plow 14 can include an optional parameter sensor 88 to determine the location of the plow 14 relative to the vehicle 12 in order to open the switch 84 of the winch-out relay. For example, the sensor 88 can be positioned in the winch motor 62 that determines the number of turns of the winch motor to thereby determine travel of the cable 18 and, hence, the plow 14. The sensor 88 can also be positioned on the support arms 16 to determine the angular position of the support arms 16 relative to the vehicle 12 to also determine positioning of the plow 14. Still further, the sensor 88 can be positioned within the plow 14 itself, such as radar or ultrasonic sensor to determine proximity of the plow 14 relative to the ground. Any of these sensors or inputs can be delivered to the controller 34 of the display 28 to open switch 84 of the winch out relay 70. Additionally, as noted above, if the optional operator presence switch 30 is used, if the driver of the vehicle 12 leaves the vehicle 12, the switch 30 will open to remove power to the winch motor 62 through either the winch-in relay 68 or the winch-out relay 70.

Figure 7B:
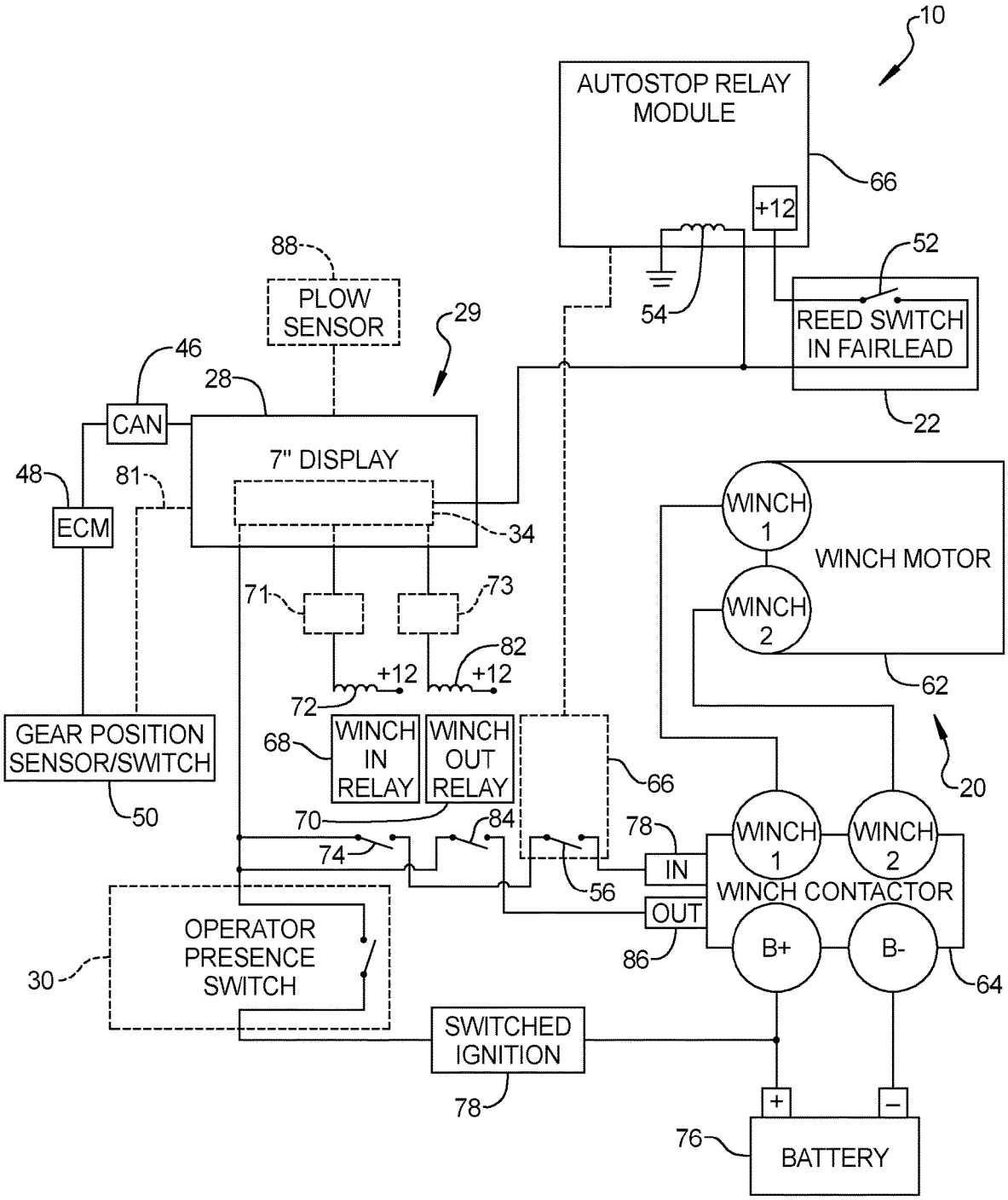
FIG. 7B is a schematic block diagram of the winch and plow control system of FIG. 7A with an alternate auto-stop relay configuration.

Referring to FIG. 7B, an alternative configuration of the system 10, illustrated in FIG. 7A, is shown. Here again, like reference numerals will be used to identify like structures and only the changes from FIG. 7A will be discussed. In this regard, in FIG. 7B, the system 10 eliminates the auto-stop relay 80 and simply uses the auto-stop relay module 66 for providing 12 volts to the winch-in input 78 of winch contactor 64. Specifically, the display module 29 is monitoring the coil side 54 of the auto-stop relay module 66 and this value will toggle between 0 volt (ground) to +12 volt when an auto-stop signal is detected by way of the reed switch 52. Upon toggling from 0 to 12 volts, the solenoid 54 will toggle switch 56, illustrated now in line with the winch-in input 78. This opens switch 56, thereby turning off winch motor 62 by no longer delivering power to the winch motor 62 through winch contactor 64, as discussed above. Such a configuration eliminates the auto-stop relay 80, as illustrated in FIG. 7, but provides the same operations, as discussed in FIG. 7.

Additionally, an optional winch-in manual rocker switch 71 is placed in line between the display module 29 and, particularly, the processor 34 and the solenoid 72. A manual winch-out rocker switch 73 is also optionally illustrated in line between the processor 34 and solenoid 82. Each of the rocker switches 71 and 73 can be provided within the vehicle 12 at a location in the vehicle so that a user can easily reach and actuate the rocker or toggle switches 71 and 73, such as on the dash, console, etc. Upon toggling each rocker switch, the corresponding solenoid 72 or 82 is provided with a ground in order to actuate either the winch-in relay 68 or the winch-out relay 70, similar to that controlled by way of the processor 34. Additionally, the processor 34 can monitor the operation of the rocker switches 71 and 73. This provides an additional level of manual control for the plow 14.

Figure 8A:
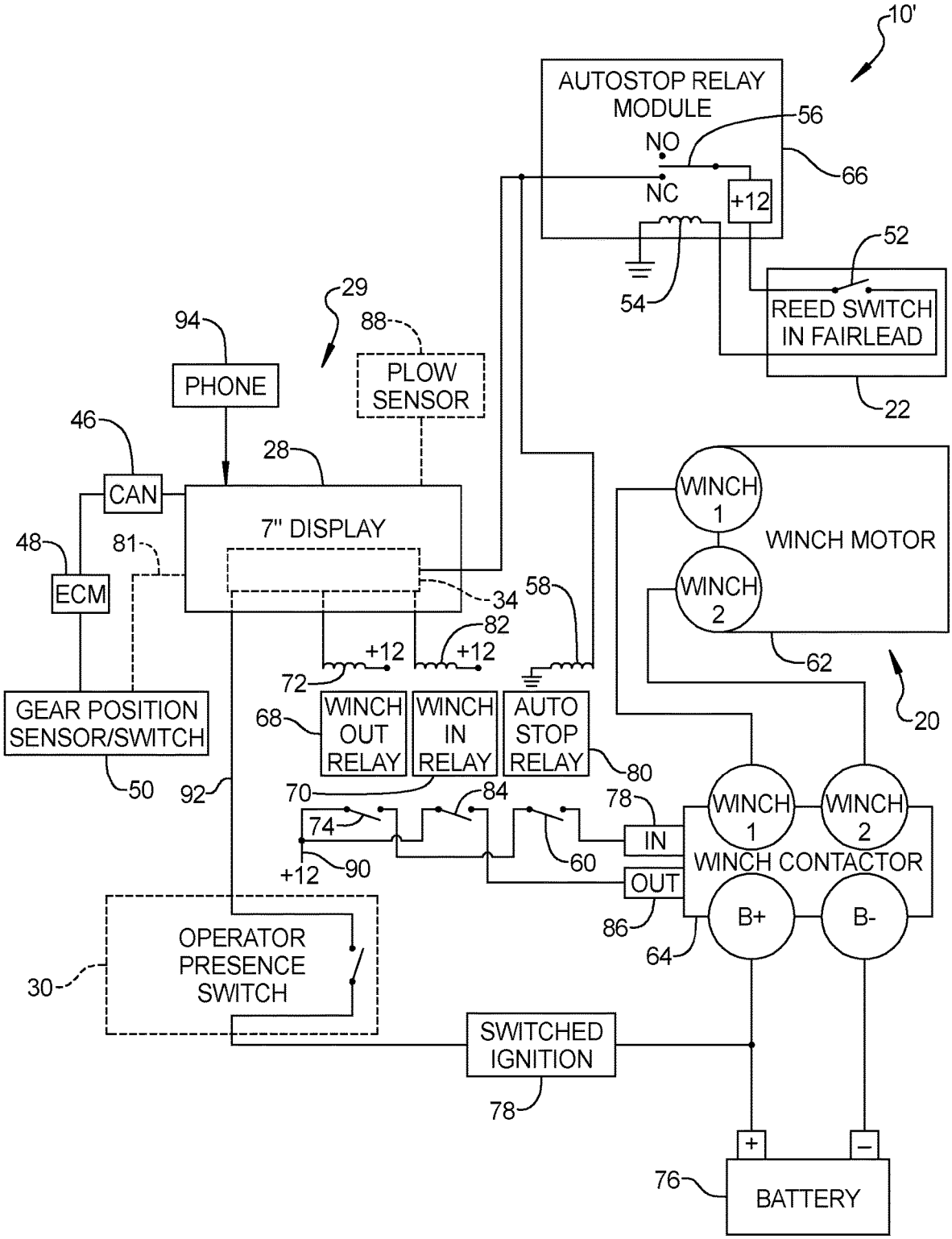
FIG. 8A is a schematic block diagram of the winch and plow control system that can include a wireless winch control feature.

Turning now to FIG. 8A, the winch and plow control system 10' according to an additional embodiment of the present disclosure is illustrated. The system 10', illustrated in FIG. 8A, is substantially similar to the system 10 illustrated in FIG. 7A and like reference numerals will be used to identify like structures. The system 10' of FIG. 8A is similar to the system 10 of FIG. 7A, except that the system 10' has a limited operator presence protection. In this regard, the operator presence switch 30 is still tied through the ignition switch 78 to battery 76. This 12 volt input through the switch 30, however, is delivered only to the display module 29 and does not deliver power to the winch-in relay 68 or winch-out relay 70 directly, as in the system 10.

The winch-in relay 68 and winch-out relay 70 have a direct 12 volt feed 90 from battery 76 and not through switch 30. Because of this, unlike system 10 where if the operator presence switch 30 is not engaged, 12 volt is removed from the winch-in relay 68 and winch-out relay 70, thereby disabling winch motor 62 from operation. The system 10' is controlled via input 92 to the processor 34 of the display 28 through switch 30. This way, the processor 34 can determine operator presence via the optional switch 30 to control the winch-in relay 68 and winch-out relay 70 that always has 12 volts available to it via feed 90. The system 10' is configured in this fashion so that the winch motor 62 can be controlled without the user being present within the vehicle 12 since the switch 30 can be bypassed if a remote operation of the winch motor 62 is desired. In this regard, power is always available to the winch-in relay 68 and the winch-out relay 70, as illustrated.

For example, the display module 29 can include wireless technology, such as Bluetooth® wireless protocol or Wi-Fi connectivity, to enable a wireless device 94, such as a wireless cell phone or key fob, to be in remote communication with display module 29. This enables a user to control the winch 20 from outside the vehicle 12 using the remote device 94, such as a phone, tablet, key fob, or other wireless device, using known wireless technology. In this way, should the vehicle 12 become stuck or if an obstacle needs to be moved relative to the vehicle 12, the occupant can leave the vehicle, but also control the winch 20 and cable 18 remotely to either pull the vehicle 12 free, if the vehicle 12 is stuck, or move an obstacle, such as a tree from a trail, with the user outside the vehicle 12.

The system 10' can do this by using the processor 34 to operate and control the winch-in relay 68 and winch-out relay 70, irrespective of what the input 92 from switch 30 is. In other words, when the display module 29 is controlled remotely, the input 92 can be ignored by the processor 34 since 12 volt power is always available to the winch-in relay 68 and winch-out relay 70. If the system 10 is wired as illustrated in FIG. 7A, this would not be possible as the 12 volt would only be available to the winch-in relay 68 and winch-out relay 70 based on the operator being present and the switch 30 being closed. With the system 10', this input can simply be bypassed, via controls in the processor 34 of the display 28. Moreover, the remote winch control can be selected, via the mode switch 38 of display 28. Additionally, the display module 29 can also wirelessly control the winch-in relay 68 and winch-out relay 70 by providing a wirelessly operated winch-in relay 68 and winch-out relay 70. This wireless communication can be by way of Bluetooth® wireless protocol or other wireless connectivity, as discussed above. In this regard, both the display module 29 and the relays 68 and 70 can have wireless connectivity.

Figure 8B:
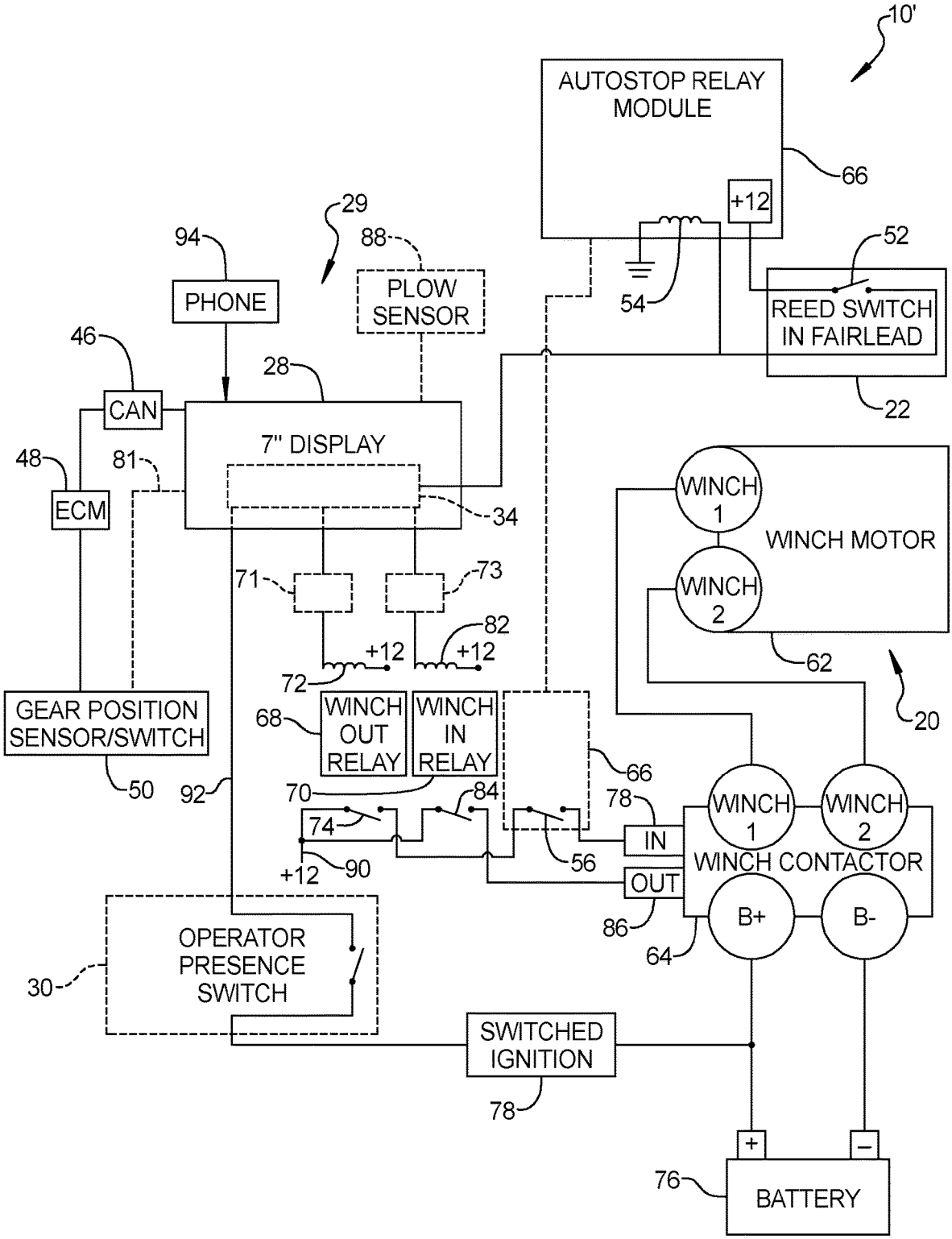
FIG. 8B is a schematic block diagram of the winch and plow control system of FIG. 8A with an alternate auto-stop relay configuration.

Referring to FIG. 8B, this figure has been modified from FIG. 8A similar to FIG. 7B from FIG. 7A. In this regard, the auto-stop relay 80 has been eliminated in FIG. 8A and the auto-stop relay module 66 having a switch 56 replaces switch 60, as noted above. Additionally, optional rocker switches 71 and 73 are also illustrated. As such, the system 10', illustrated in FIG. 8B, operates similar to the system 10' in FIG. 8B.

Figure 9:
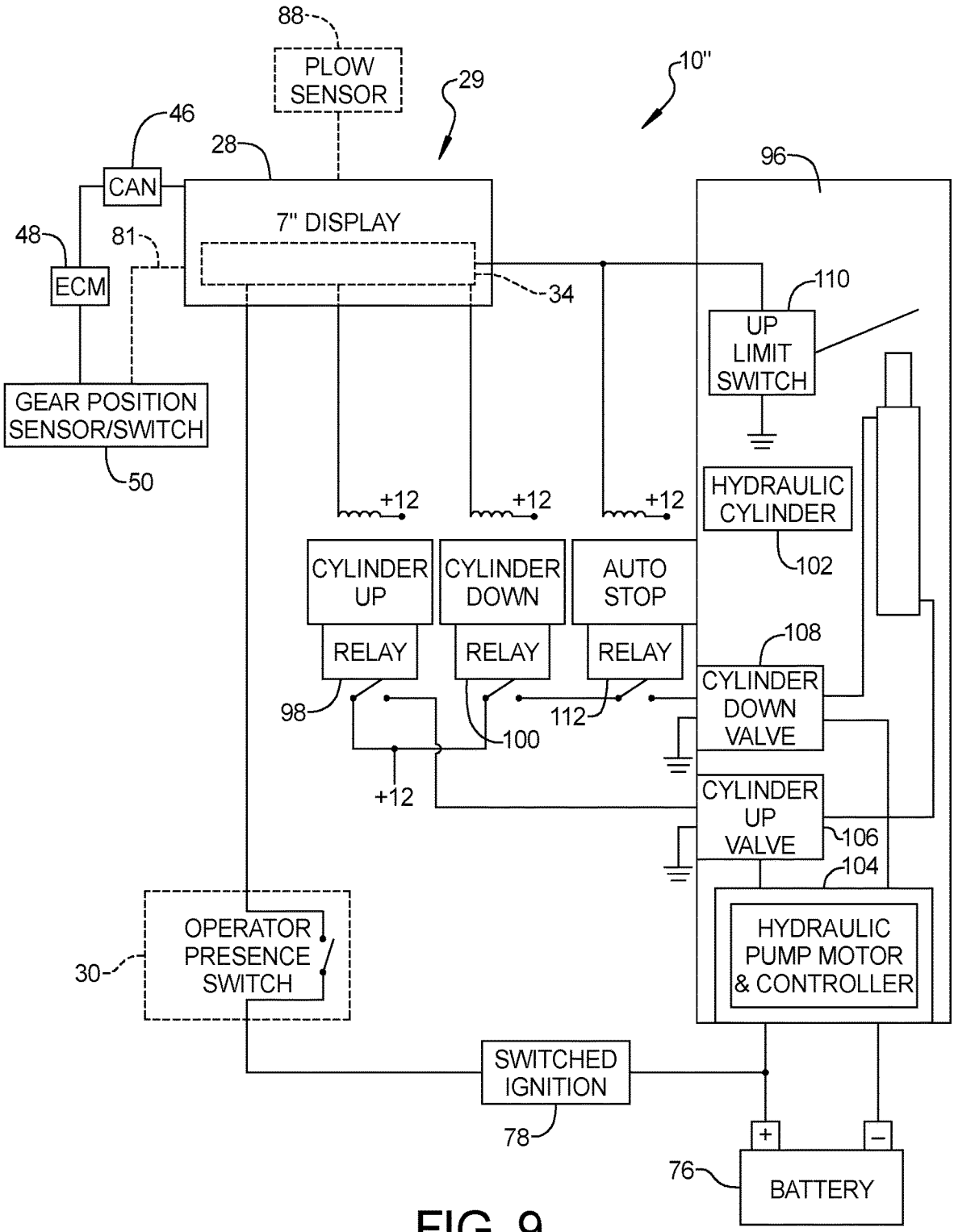
FIG. 9 is a schematic block diagram of the winch and plow control system utilizing a hydraulic plow system.

Turning now to FIG. 9, a schematic block diagram of a system 10" according to another embodiment of the disclosure is illustrated. As previously noted, like reference numeral will be used to identify like structures with system 10". System 10" is similar to the systems 10 and 10' illustrated in FIGS. 7A-8B, except that the plow mechanism having the winch 20 having the winch motor 62 and winch contactor 64 are replaced with a hydraulic system 96 used for raising and lowering the plow 14. Here again, the system 10" includes the display module 29 having the processor 34 and the associated inputs of a parameter sensor, such as the gear position switch 60 delivered, via the ECM 48 and CAN bus 46 or directly through the analog input 81. System 10" also includes the battery 76, the ignition switch 78, and the optional operator presence switch 30. The winch-in relay 68 and winch-out relay 70 are replaced by a cylinder-up relay 98 and a cylinder-down relay 100. The cylinder-up relay 98 and the cylinder-down relay 100 operate similarly to the winch-in relay 68 and winch-out relay 70, except that they control a hydraulic cylinder 102 that moves the plow 14. The hydraulic system 96 further includes a hydraulic pump motor and control 104 that delivers hydraulic fluid to the hydraulic cylinder 102, via a cylinder-up valve 106 and a cylinder-down valve 108. The hydraulic system 96 further includes an up-limit switch 110 that controls an auto-stop relay 112 similar to auto-stop relay 80 and auto-stop module 66. In this regard, the operation of the auto-stop is substantially similar, except that the reed switch 52 with the fairlead 22 and the magnets in the rubber stopper 24 are replaced with the limit switch 110 that monitors the position of the hydraulic cylinder 102.

The system 10" operates as follows. In the manual mode, the plow 14 can be raised and lowered via the display module 29, as discussed above, by using the cylinder-up relay 98 or the cylinder-down relay 100. In the automatic plow mode, for example, in the forward or low gear, the gear sensor switch 50 senses the gear position and provides this to the display module 29. The processor 34 again actuates the cylinder-down relay 100 to deliver 12 volts to the cylinder-down valve 108. This opens the valve 108 of the hydraulic cylinder 102, thereby allowing the plow 14 to lower based on gravity to the ground. The plow sensor 88 can optionally be used to also determine the location of the plow 14 relative to the vehicle 12, as discussed above. When the vehicle 12 is put into reverse, the switch 50 senses the gear position and again provides this information to the display module 29. This causes the processor 34 to actuate the cylinder-up relay 98 to deliver 12 volts to the cylinder-up valve 106 to thereby open the valve and deliver hydraulic fluid from the hydraulic pump 104 to the hydraulic cylinder 102 to raise the plow 14. The plow 14 is raised until the up-limit switch 110 senses the hydraulic cylinder 102, thereby actuating the auto-stop relay 112 in order to stop the plow 14 from raising further. In the backdrag plow mode, the cylinder-up relay 98 and cylinder-down relay 100 are controlled in an opposite manner, as further discussed herein.

Figure 10:
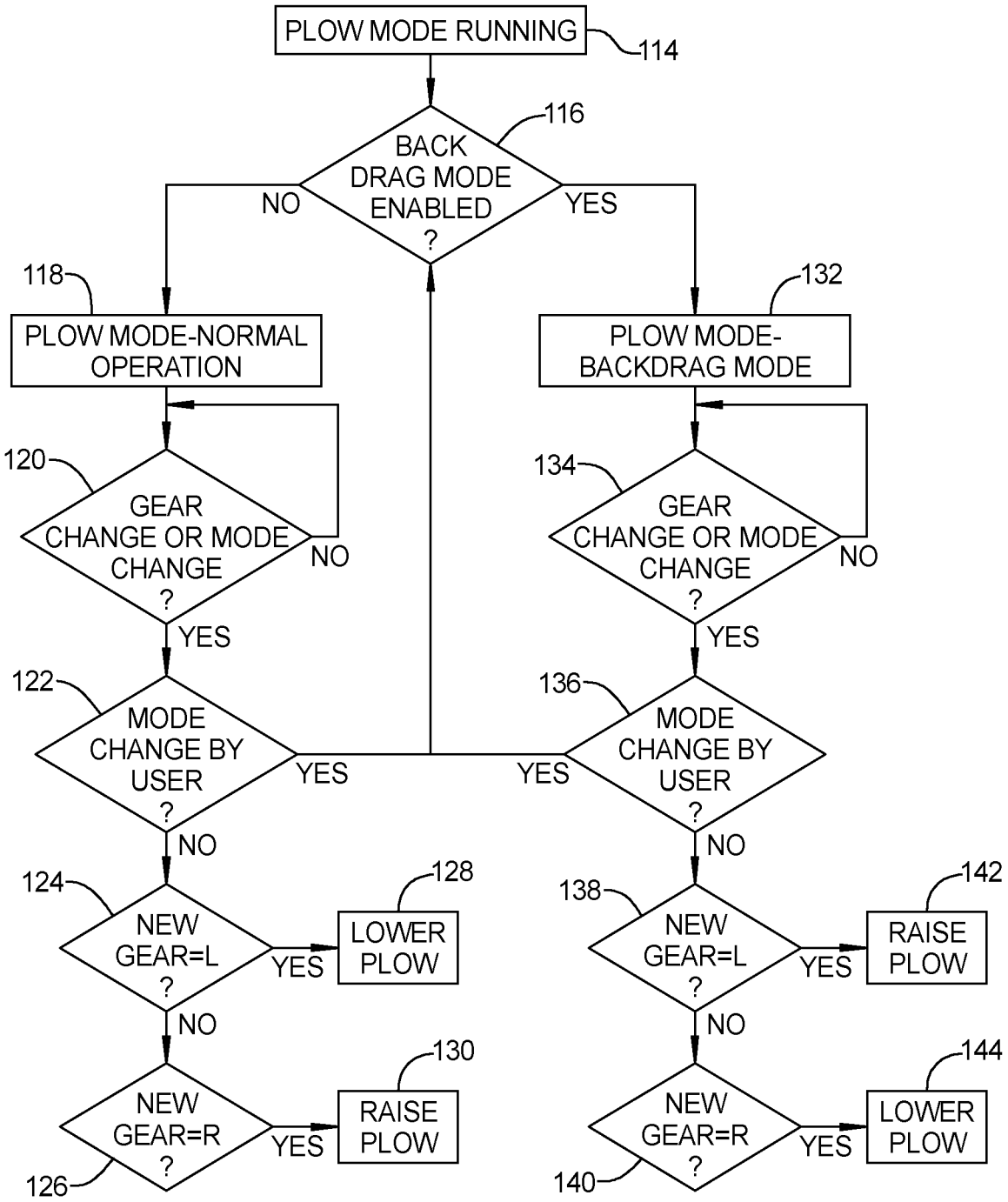
FIG. 10 is a logic block diagram illustrating plow mode logic and backdrag mode logic.

Referring to FIG. 10, a logic block diagram illustrating the logic instructions present in the display module 29 is illustrated. Initially, a user will actuate the mode switch 38 of the display module 29 to either select a manual plow mode to use the up switch 40 and the down switch 42. Alternatively, the user may use the mode switch 38 to select the plow mode 114. With the plow mode running, the system 10, 10', and 10" proceeds to decision block 116 to determine if the backdrag mode is enabled. If the backdrag mode is not enabled, the procedure follows the NO path to the plow mode normal operation block 118.

In the plow mode normal operation 118, the system 10 continuously monitors for either a gear change or a mode change in decision block 120, including after determining plow position. If there is no gear change or mode change, decision block 120 simply continues to monitor for these changes, via the NO feedback path. Should a change be detected, the process proceeds down the YES path to decision block 122. At decision block 122, a determination is made if a mode change has been selected by the user. If a mode change has been selected, the YES path is followed. If the mode change has not been selected, the NO path is followed to decision block 124 and decision block 126. At decision block 124, it is determined if a new gear selection for forward or low gear has been made. If this selection has been made, the YES path is followed and the plow 14 is lowered in the lower plow block 128. If the new gear is not forward or low gear, then the NO path is taken to decision block 126. At decision block 126, it is determined if the reverse gear has been selected. If so, the YES path is taken and the plow 14 is raised in the raise plow block 130.

Should the backdrag mode be enabled and determined in decision block 116, the YES path is followed and the plow mode operating in the backdrag mode 132 is then followed. From the backdrag mode block 132, the process proceeds to decision block 134 where the system 10 continuously monitors for either a gear change or a mode change. Should there be no change in the gear or mode, the NO feedback loop continues until a change is detected, in which time the YES path is followed to decision block 136. In decision block 136, it is determined if the user has changed the mode from backdrag mode to normal plow mode. If so, the YES path is taken to return to the plow mode normal operation 118 path. If the user has not changed the mode and the mode stays in the backdrag mode, the process proceeds to decision blocks 138 and 140. At decision block 138, it is determined if the new gear selection is low or forward gear. If this gear has been selected, the YES path is taken and the plow 14 is raised in the raise plow block 142. If low gear has not been selected, then the NO path is followed to decision block 140. At decision block 140, it is determined and confirmed if the gear selection is in reverse. If so, the YES path is taken and the plow 14 is lowered in the lower plow block 144.

As noted above, in the plow mode normal operation 118, the system 10 continuously monitors for either a gear change or a mode change in decision block 120, including after determining plow position. Thus, the system 10 will monitor for a change after selected a position of the plow is made. Accordingly, the system 10 may operate as a loop during operation of the plow and/or vehicle.

As noted from the logic discussed above, the automatic plow mode can be either operated in a normal mode where the plow is automatically lowered when the vehicle 12 is put into a forward gear and the plow is raised when the vehicle is put into a reverse gear. Conversely, in the backdrag mode, the plow is automatically raised when the vehicle 12 is put into low gear and the plow is lowered when the vehicle 12 is put into a reverse gear. This enables the user of the vehicle 12 to pull snow away from areas in reverse, such as removing snow from in front of a garage door or entrance by pulling the snow away from this area. The controls for the raising and lowering of the plow, as illustrated above, are tied to the winch-in relay 68 and winch-out relay 70 or the cylinder-up relay 98 or cylinder-down relay 100, which are all controlled by way of the processor 34 and the display module 29.

The above-described tasks are meant to be illustrative examples; the tasks may be performed sequentially, synchronously, simultaneously, continuously, during overlapping time periods or in a different order depending upon the application. Also, any of the tasks may not be performed or skipped depending on the implementation and/or sequence of events.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term 'module' or the term 'controller' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a module.

The term code or logic, as used above, may include software, firmware, and/or microcode, and may refer to programs, routines, functions, classes, data structures, and/or objects. The term processor or controller encompasses a single processor circuit that executes some or all code or logic from multiple modules. The processor can encompass a processor circuit that, in combination with additional processor circuits, executes some or all code from one or more modules. References to processor or controller also encompasses multiple processor circuits on discrete dies, multiple processor circuits on a single die, multiple cores of a single processor circuit, multiple threads of a single processor circuit, or a combination of the above. The term memory encompasses a memory circuit that stores some or all code from multiple modules. The term memory also encompasses a memory circuit that, in combination with additional memories, stores some or all code from one or more modules.

The term memory includes computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, a Blu-ray Disc® magneto-optical disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A plow control system for use in controlling a plow on a vehicle, comprising:

a plow mechanism configured to move the plow in a first direction and a second direction;

a parameter sensor configured to sense a vehicle parameter;

a control module configured to operate the plow in a manual mode and an automatic mode;

a mode select switch configured to select the manual mode or the automatic mode; and a direction control switch configured to direct the plow mechanism to move the plow in the first direction or the second direction;

wherein in the automatic mode, the plow is moved in the first direction or the second direction upon the control module receiving the vehicle parameter from the parameter sensor;

wherein the automatic mode includes a normal plow mode and a back drag plow mode;

wherein in the automatic back drag plow mode, the control module is configured to automatically move the plow in a first raised direction upon the parameter sensor sensing a forward gear vehicle parameter of the vehicle and configured to automatically move the plow in a second lowered direction upon the parameter sensor sensing a reverse gear vehicle parameter of the vehicle.

2. The system of claim 1, wherein in the manual mode, the plow is moved in the first direction or the second direction upon activation of the direction control switch.

3. The system of claim 1 wherein in the automatic normal plow mode, the control module is configured to move the plow in a first lowered direction upon the parameter sensor sensing a forward gear vehicle parameter of the vehicle and configured to move the plow in a second raised direction upon the parameter sensor sensing a reverse gear vehicle parameter of the vehicle.

4. The system of claim 1, wherein the plow mechanism is an electric winch.

5. The system of claim 1, wherein the electric winch includes a winch motor, a winch contactor, and winch-in and winch-out relays.

6. The system of claim 1, wherein the plow mechanism is a hydraulic pump motor and controller.

7. The system of claim 1, wherein the parameter sensor senses a gear position of the vehicle.

8. The system of claim 7, wherein the gear position parameter is provided to the control module via a control area network (CAN) bus.

9. The system of claim 1, wherein the control module is a display module that includes a processor, the mode select switch, and the direction control switch.

10. The system of claim 9, wherein the direction control switch includes a plow up switch and a plow down switch.

11. The system of claim 10, wherein the plow up switch and the plow down switch are implemented on a display touch screen of the display module.

12. The system of claim 11, wherein the plow up switch operates upon touching and swiping a plow up button to move the plow in an up direction.

13. The system of claim 9, wherein the display module is configured to be controlled remotely to operate the plow mechanism.

14. The system of claim 1, wherein the control module is configured to turn the plow mechanism off upon the plow reaching a predetermined position.

15. A plow control system for use in controlling a plow in a vehicle, comprising:

an electric winch mechanism configured to move the plow up and down;

a gear position sensor configured to sense a vehicle gear position of the vehicle;

a display module having a processor and configured to control the electric winch mechanism;

a mode select switch configured to select a normal plow mode or a back drag plow mode; and a direction control switch configured to direct the electric winch mechanism to move the plow up or down;

wherein in the back drag plow mode, the plow is automatically moved down upon the display module receiving a reverse gear position from the gear position sensor and the plow is automatically moved up upon the display module receiving a forward gear position from the gear position sensor.

16. The system of claim 15, wherein the mode select switch and the direction control switch are touch screen control switches.

17. The system of claim 16, wherein the direction control switch includes an up direction control switch and a down direction control switch wherein each switch requires a user to touch and swipe the switch to move the plow.

18. The system of claim 15, wherein the display module is configured to turn the electric winch mechanism off upon the plow reaching a predetermined position.

* * * * *